US006347979B1

(12) United States Patent
Drill

(10) Patent No.: US 6,347,979 B1
(45) Date of Patent: Feb. 19, 2002

(54) SLURRY DISPENSING CARRIER RING

(75) Inventor: Charles Franklin Drill, Boulder Creek, CA (US)

(73) Assignee: VSLI Technology, Inc., San Jose, CA (US)

( * ) Notice: Subject to any disclaimer, the term of this patent is extended or adjusted under 35 U.S.C. 154(b) by 0 days.

(21) Appl. No.: 09/163,295

(22) Filed: Sep. 29, 1998

(51) Int. Cl.[7] ..... B24B 57/00; B24B 7/19; B24B 7/30

(52) U.S. Cl. ..... 451/41; 451/60; 451/285; 451/287; 451/446

(58) Field of Search ..... 451/446, 60, 285, 451/287, 41

(56) References Cited

U.S. PATENT DOCUMENTS 5,584,751 A * 12/1996 Kobayashi et al. ..... 451/288
5,797,789 A * 8/1998 Tanaka et al. ..... 451/289
5,803,799 A * 9/1998 Volodarsky et al. ..... 451/288
5,810,648 A * 9/1998 Jiang et al. ..... 451/285
5,816,900 A * 10/1998 Nagahara et al. ..... 451/285
5,820,448 A * 10/1998 Shamouilian et al. ..... 451/287
5,836,807 A * 11/1998 Leach ..... 451/41
5,902,173 A * 5/1999 Tanaka ..... 451/56
5,931,725 A * 8/1999 Inaba et al. ..... 451/288
6,062,959 A * 5/2000 Weldon et al. ..... 451/307

* cited by examiner

*Primary Examiner*—Allen Ostrager
*Assistant Examiner*—William Hong
(74) *Attorney, Agent, or Firm*—Wagner Murabito & Hao LLP

(57) ABSTRACT

A slurry dispensing carrier ring for confining a semiconductor wafer to a polishing pad in a chemical mechanical polishing machine. The slurry dispensing ring has a diameter and a lower surface substantially parallel to the plane defined by the diameter and an inner radius surface substantially orthogonal to the plane defined by the diameter. The inner radius surface is adapted to confine the semiconductor wafer. An outer radius surface is located opposite the inner radius surface. An upper surface is located opposite the lower surface. A slurry dispense hole extends through the carrier ring from the upper surface to the lower surface, wherein the slurry dispense hole is adapted to flow a slurry used for chemical mechanical polishing from the chemical mechanical polishing machine to the lower surface so that the slurry contacts the semiconductor wafer confined within the inner radius surface. This provides for the more efficient utilization of slurry in the CMP process wherein a planar topography is created on the semiconductor wafer. This facilitates the subsequent semiconductor processing steps performed on the semiconductor wafer and minimizes the amount of wasted slurry.

8 Claims, 16 Drawing Sheets

SLURRY DISPENSING CARRIER RING

FIELD OF THE INVENTION

The field of the present invention pertains to semiconductor fabrication processing. More particularly, the present invention relates to a device for more efficiently utilizing slurry for polishing a semiconductor wafer in a chemical mechanical polishing machine.

BACKGROUND OF THE INVENTION

Most of the power and usefulness of today's digital IC devices can be attributed to the increasing levels of integration. More and more components (resistors, diodes, transistors, and the like) are continually being integrated into the underlying chip, or IC. The starting material for typical ICs is very high purity silicon. The material is grown as a single crystal. It takes the shape of a solid cylinder. This crystal is then sawed (like a loaf of bread) to produce wafers typically 10 to 30 cm in diameter and 250 microns thick.

The geometry of the features of the IC components are commonly defined photographically through a process known as photolithography. Very fine surface geometries can be reproduced accurately by this technique. The photolithography process is used to define component regions and build up components one layer on top of another. Complex ICs can often have many different built-up layers, each layer having components, each layer having differing interconnections, and each layer stacked on top of the previous layer. The resulting topography of these complex IC's often resemble familiar terrestrial "mountain ranges," with many "hills" and "valleys" as the IC components are built up on the underlying surface of the silicon wafer.

In the photolithography process, a mask image, or pattern, defining the various components, is focused onto a photosensitive layer using ultraviolet light. The image is focused onto the surface using the optical means of the photolithography tool, and is imprinted into the photosensitive layer. To build ever smaller features, increasingly fine images must be focused onto the surface of the photosensitive layer, e.g. optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor in the degree of resolution obtainable, and thus, the smallest components obtainable using the photolithography tool. The extreme topography of complex ICs, the "hills" and "valleys," exaggerate the effects of decreasing depth of focus. Thus, in order properly to focus the mask image defining sub-micron geometries onto the photosensitive layer, a precisely flat surface is desired. The precisely flat (e.g. fully planarized) surface will allow for extremely small depths of focus, and in turn, allow the definition and subsequent fabrication of extremely small components.

Chemical-mechanical polishing (CMP) is the preferred method of obtaining full planarization of a wafer. It involves removing a sacrificial layer of dielectric material using mechanical contact between the wafer and a moving polishing pad with chemical assistance from a polishing slurry. Polishing flattens out height differences, since high areas of topography (hills) are removed faster than areas of low topography (valleys). Polishing is the only technique with the capability of smoothing out topography over millimeter scale planarization distances leading to maximum angles of much less than one degree after polishing.

FIG. 1A shows a down view of a CMP machine 100 and FIG. 1B shows a side cut away view of the CMP machine 100 taken through line AA. The CMP machine 100 is fed wafers to be polished. The CMP machine 100 picks up the wafers with an arm 101 and places them onto a rotating polishing pad 102. The polishing pad 102 is made of a resilient material and is textured, often with a plurality of predetermined groves 103, to aid the polishing process. The polishing pad 102 rotates on a platen 104, or turn table located beneath the polishing pad 102, at a predetermined speed. A wafer 105 is held in place on the polishing pad 102 and the arm 101 by a carrier ring 112 and a carrier 106. The lower surface of the wafer 105 rests against the polishing pad 102. The upper surface of the wafer 105 is against the lower surface of the carrier 106 of the arm 101. As the polishing pad 102 rotates, the arm 101 rotates the wafer 105 at a predetermined rate. The arm 101 forces the wafer 105 into the polishing pad 102 with a predetermined amount of down force. The CMP machine 100 also includes a slurry dispense arm 107 extending across the radius of the polishing pad 102. The slurry dispense arm 107 dispenses a flow of slurry onto the polishing pad 102.

CMP machine 100 also includes a conditioner assembly 120, which includes a conditioner arm 108 extending across the radius of the polishing pad 102. An end effector 109 is connected to the conditioner arm 108. The end effector 109 includes an abrasive conditioning disk 110 which is used to roughen the surface of the polishing pad 102, thereby improving the transport of slurry to and from wafer 105.

The slurry is a mixture of de ionized water and polishing agents designed to aid chemically the smooth and predictable planarization of the wafer. The rotating actions of both the polishing pad 102 and the wafer 105, in conjunction with the polishing action of the slurry, combine to planarize, or polish, the wafer 105 at some nominal rate. This rate is referred to as the removal rate. A constant and predictable removal rate is important to the uniformity and performance of the wafer fabrication process. The removal rate should be expedient, yet yield precisely planarized wafers, free from surface topography. If the removal rate is too slow, the number of planarized wafers produced in a given period of time decreases, degrading wafer through-put of the fabrication process. If the removal rate is too fast, the CMP planarization process will not be uniform across the surface of the wafers, degrading the yield of the fabrication process.

Referring still to FIG. 1A and FIG. 1B, the polishing action of the slurry largely determines the removal rate and removal rate uniformity, and, thus, the effectiveness of the CMP process. As slurry is "consumed" in the polishing process, the transport of fresh slurry to the surface of the wafer 105 and the removal of polishing by-products away from the surface of the wafer 105 become very important in maintaining the removal rate. Slurry transport is facilitated by the texture of the surface of the polishing pad 102. This texture is comprised of both predefined pits and grooves 103 that are manufactured into the surface of the polishing pad 102 and the inherently rough surface of the material from which the polishing pad 102 is made.

Referring now to FIG. 2A, FIG. 2B, FIG. 2C and FIG. 2D, the relationships between a wafer, a carrier ring, and a polishing pad are shown (for teaching purposes, the above elements are not necessarily drawn to scale). FIG. 2A and FIG. 2B show a wafer 105 and a carrier ring 112 respectively. FIG. 2C and FIG. 2D show a side view of the wafer 105 in the carrier ring 112 on a polishing pad 102. As described above, the wafer 105 is held in place on the arm (not shown) by the carrier ring 112 as the polishing pad 102 rotates on the polishing platen. The carrier ring 112 accepts the wafer 105 within its inner radius surface 201. The upper surface of the wafer 105 is against the carrier 106 (not shown) of the arm. The carrier 106 (not shown) presses the wafer into the polishing pad with a predetermined force. As the polishing pad 102 rotates, carrier 106 (not shown) rotates the wafer 105.

Referring still to FIG. 2D, the wafer 105 typically protrudes slightly, relative to the lower surface of carrier ring 112. This gives the polishing pad 102 and the slurry (not shown) on the polishing pad 102 an even contact with wafer 105. The carrier ring 112 holds the wafer 105 in place while the polishing pad 102 and the slurry polish the wafer 105. Polishing pad 102 frictionally slides against the lower surface of carrier ring 112 and against wafer 105. The predetermined amount of down force increases the friction between polishing pad 102, carrier ring 112, and wafer 105, thus increasing the removal rate. As depicted in FIG. 2D, wafer 105 protrudes by a positive protrusion amount past the lower surface of the carrier ring 112. This gives the polishing pad 102 and the slurry (not shown) on the polishing pad 102 less obstructed contact with the wafer 105. The carrier ring 112 inherently obstructs a certain amount of slurry flow onto and under the wafer 105. The carrier ring 112 must hold the wafer 105 in place while the polishing pad 102 and the slurry polish the wafer 105. Even though the carrier ring 112 obstructs a certain amount of slurry flow, enough slurry contacts the wafer 105 to complete a polishing cycle.

The problem, however, is that the period of time required to complete the polishing cycle is increased due to the inherent obstruction of slurry flow to the wafer by the carrier ring. In a typical CMP machine (e.g., CMP machine 100), the slurry is dispensed from the slurry dispense arm 107 onto polishing pad 102, as polishing pad 102 rotates. The slurry spreads nearly uniformly across the surface of polishing pad 102 due to the movement and action of the CMP machine 100 (e.g., centrifugal force, movement of wafer 105 and carrier ring 112 by arm 101, etc.). Only a small portion if the slurry dispensed by slurry dispense arm 107 ever comes into contact with wafer 105. The majority of the slurry is wasted, as it eventually flows off of polishing pad 102.

Slurry represents the most expensive consumable used in the CMP process. As described above, the CMP process uses an abrasive slurry on a polishing pad. The polishing action of the slurry is comprised of an abrasive frictional component and a chemical component. The abrasive frictional component is due to the friction between the surface of the polishing pad, the surface of the wafer, and abrasive particles suspended in the slurry. The chemical component is due to the presence in the slurry of polishing agents which chemically interact with the material of the dielectric layer. The chemical component of the slurry is used to soften the surface of the dielectric layer to be polished, while the frictional component removes material from the surface of the wafer.

The constituents of the slurry are precisely determined and controlled in order to effect the most optimal CMP planarization. Differing slurries are used for differing layers of the semiconductor wafer, with each slurry having specific removal characteristics for each type of layer. As such, slurries used in extremely precise sub-micron processes (e.g., tungsten damascene planarization) can be very expensive. Accordingly, the wasting of such slurry is to be avoided where ever possible.

One prior art solution to this problem involves slurry reuse, where the slurry which flows off of the polishing pad (e.g., polishing pad 102) is removed (e.g., by suction, drainage, etc.) and recycled via filtration or other similar means. The problem with this solution is that the removed slurry is typically contaminated with polishing by-product. Filtration and other such means may not be sufficient to recycle fully the potency of the slurry. For example, some contaminants may remain after the filtration, or one or more of the chemical components of the slurry may be consumed.

Thus what is required is a device which reduces the waste of slurry in the CMP process of a CMP machine. What is required is a device which reduces the amount of wasted slurry without the drawbacks of prior art slurry recycling schemes. What is further required is a device which renders the CMP process more cost effective by using slurry in the most efficient manner. The present invention provides a novel solution to the above requirements.

SUMMARY OF THE INVENTION

The present invention provides a device that reduces the waste of slurry in the CMP process of a CMP machine. The present invention provides a device that reduces the amount of wasted slurry without the drawbacks of prior art slurry recycling schemes. In addition, the present invention provides a device that renders the CMP process more cost effective by using slurry in the most efficient manner.

In one embodiment, the present invention comprises a slurry dispensing carrier ring for confining a semiconductor wafer to a polishing pad in a chemical mechanical polishing machine. The slurry dispensing ring has a diameter, a lower surface substantially parallel to the plane defined by the diameter, and an inner radius surface substantially orthogonal to the plane defined by the diameter. The inner radius surface is adapted to confine the semiconductor wafer. An outer radius surface is located opposite the inner radius surface. An upper surface is located opposite the lower surface.

A plurality of slurry dispense holes extends through the carrier ring from the upper surface to the lower surface, wherein the slurry dispense holes are adapted to flow a slurry used for chemical mechanical polishing from the CMP machine to the lower surface so that the slurry contacts the semiconductor wafer confined within the inner radius surface. This provides for the more efficient utilization of slurry in the CMP process wherein a planar topography is created on the semiconductor wafer. This facilitates the subsequent semiconductor processing steps performed on said semiconductor wafer and minimizes the amount of wasted slurry, thereby rendering the CMP process more cost effective by using slurry in the most efficient manner.

The precisely metered and targeted delivery of slurry minimizes the exposure of the slurry to the atmosphere, thereby minimizing any possible contamination or degradation of the slurry due to contact with atmospheric gasses (e.g., oxygen). The targeted delivery of slurry also enhances the ability of the CMP machine to regulate precisely the temperature of the slurry as it is used in the CMP process.

BRIEF DESCRIPTION OF THE DRAWINGS

The present invention is illustrated by way of example and not by way of limitation, in the figures of the accompanying drawings and in which like reference numerals refer to similar elements and in which.

Prior Art

Prior Art

DETAILED DESCRIPTION OF THE INVENTION

Reference will now be made in detail to the preferred embodiments of the invention, a method and system for detection user data types in digital communications channels and optimizing encoding-error correction in response thereto, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not unnecessarily to obscure aspects of the present invention.

The present invention provides a device that reduces the waste of slurry in the CMP process of a CMP machine. The present invention provides a device that reduces the amount of wasted slurry without the drawbacks of prior art slurry recycling schemes. In addition, the present invention provides a device that renders the CMP process more cost effective by using slurry in the most efficient manner. The present invention and its benefits are described in greater detail below.

Chemical-mechanical polishing (CMP) is the preferred method of obtaining full planarization of a semiconductor wafer containing devices for fabrication processing. The CMP process involves removing a sacrificial layer of dielectric material using both the frictional contact between the wafer and a moving polishing pad saturated with a polishing slurry and the chemical action of the slurry itself. Polishing through the CMP process flattens out height differences since high areas of topography (hills) are removed faster than areas of low topography (valleys). The CMP process is the preferred technique with the capability of smoothing out topography over millimeter scale planarization distances leading to maximum angles of much less than one degree after polishing.

The CMP process can be very expensive, particularly with the more precise fabrication processes (e.g., deep submicron lithography, etc.). The most expensive incremental cost of the CMP process for each process semiconductor wafer is the slurry. As each wafer processed, a significant amount of slurry is consumed. The present invention minimizes this amount of consumed slurry.

Figure 1A:
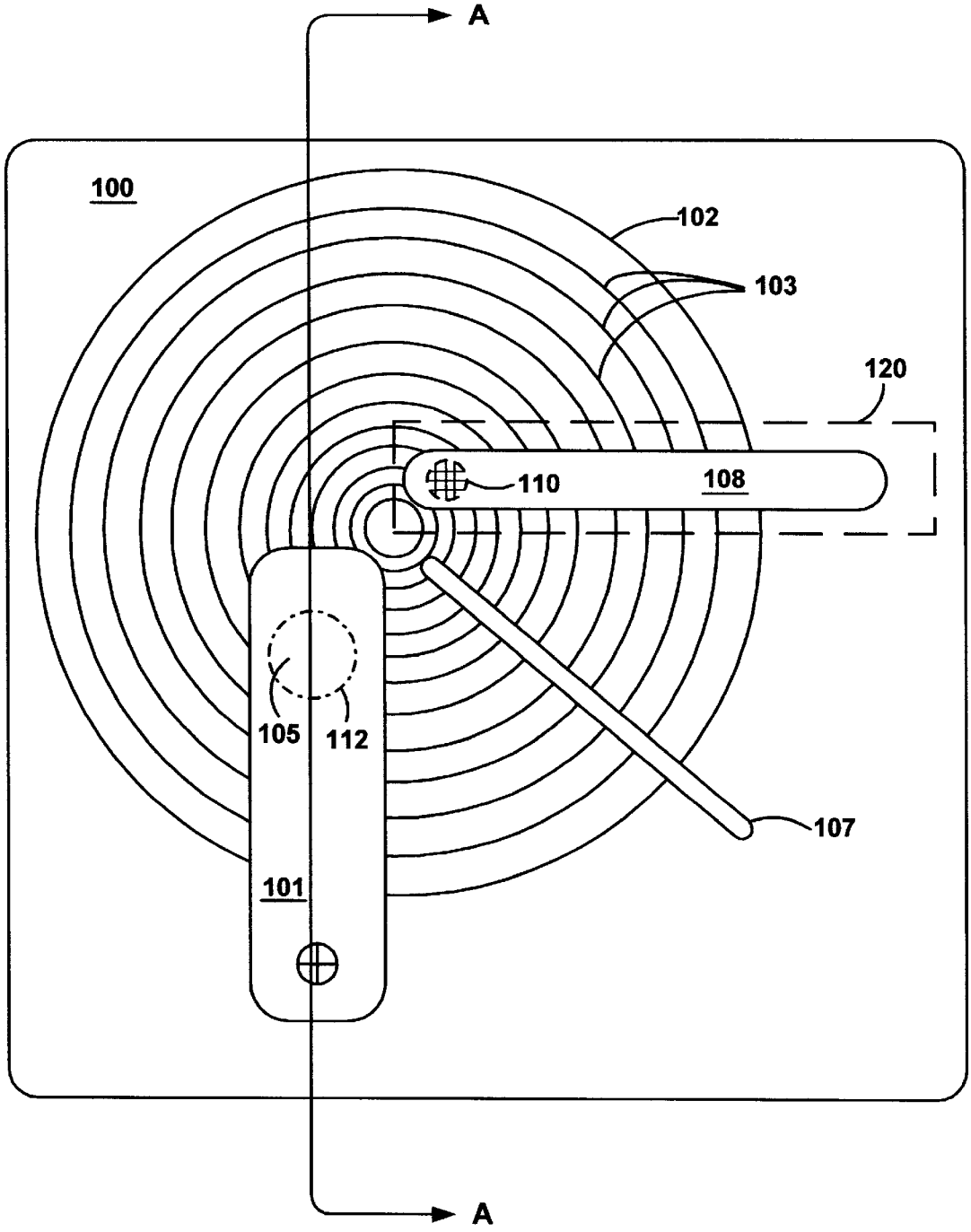
FIG. 1A (Prior Art)
FIG. 1A shows a down view of a prior art CMP machine.
Figure 1B:
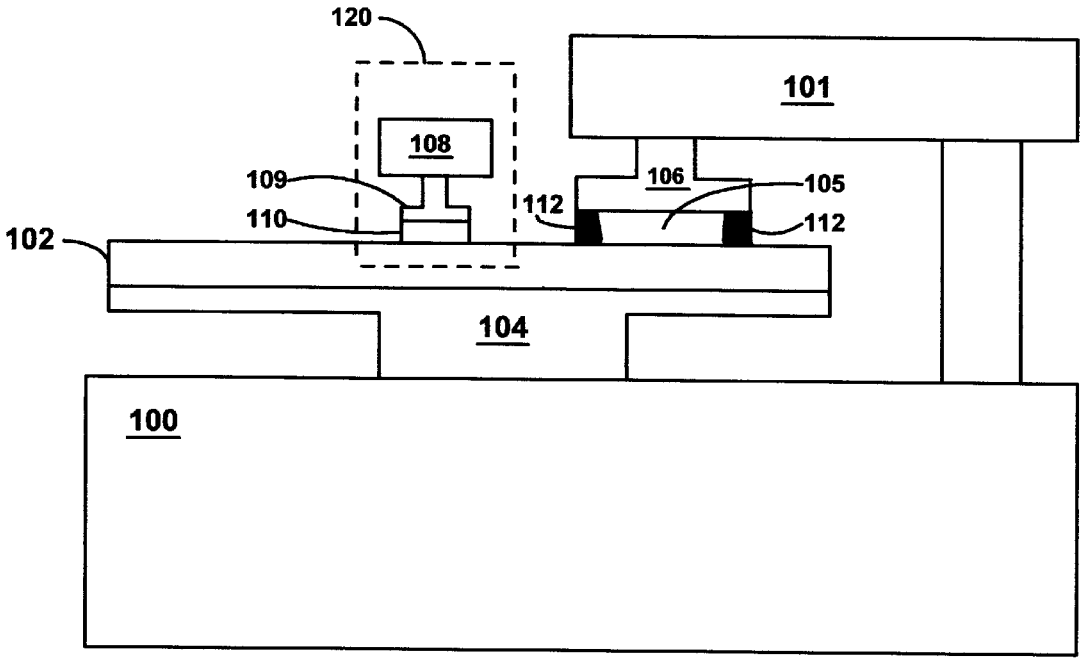
FIG. 1B (Prior Art)
FIG. 1B shows a side cut away view of the prior art CMP machine of FIG. 1A.
Figure 2A:
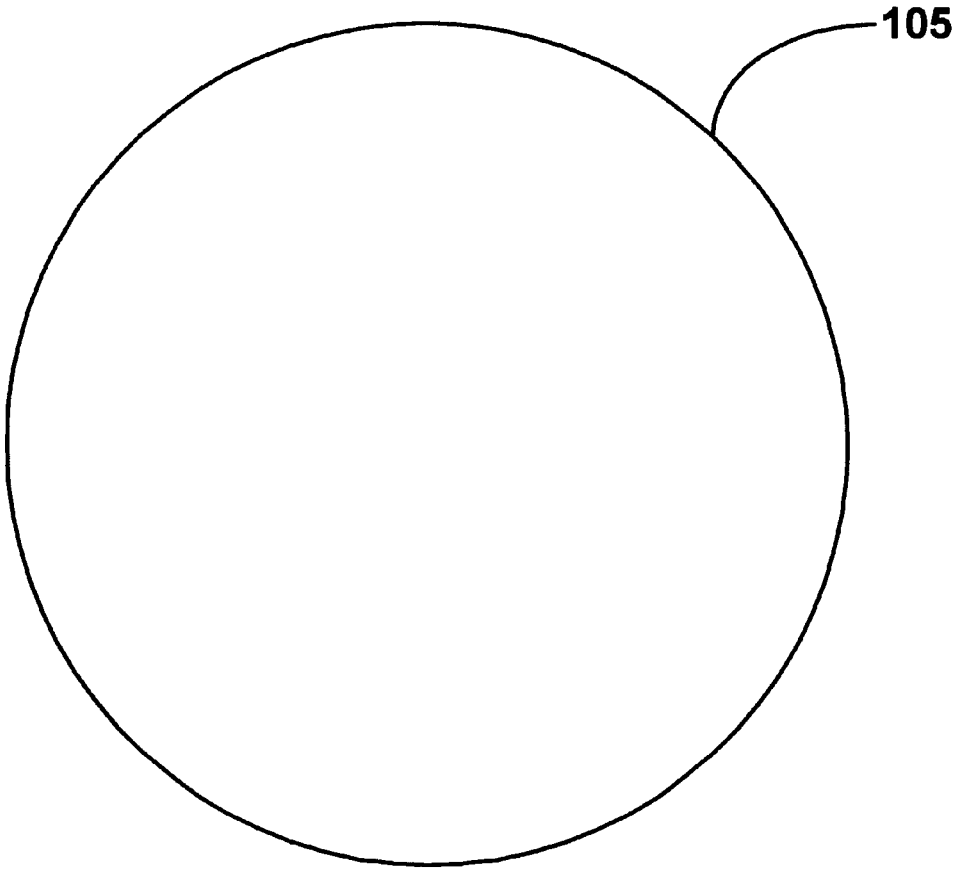
FIG. 2A (Prior Art)
FIG. 2A shows a prior art wafer.
Figure 2B:
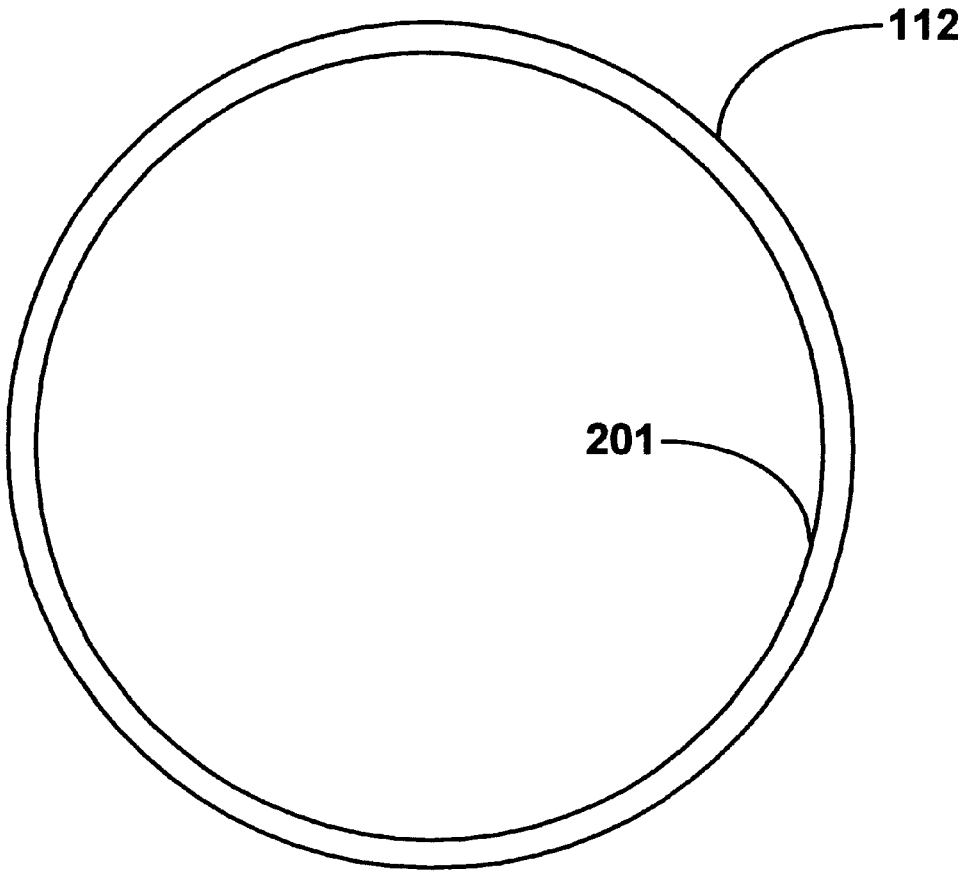
FIG. 2B (Prior Art)
FIG. 2B shows a prior art carrier ring.
Figure 2C:
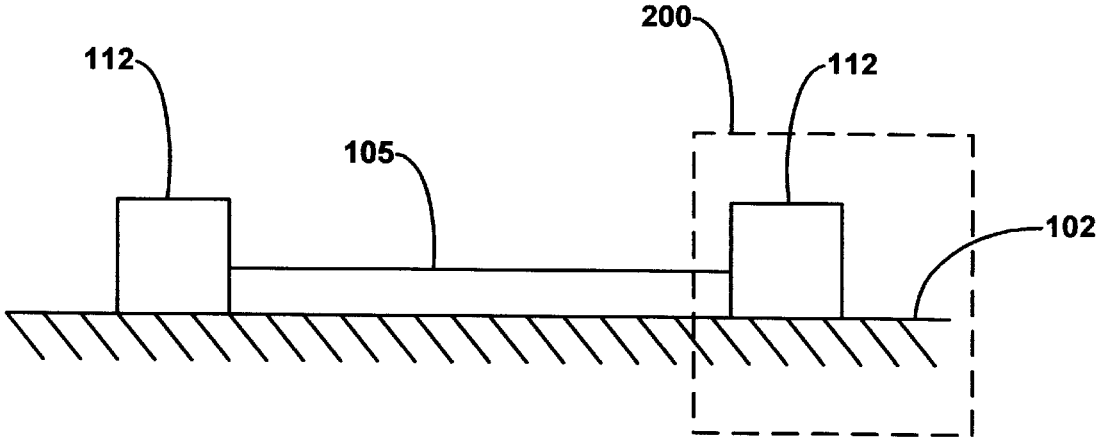
FIG. 2C (Prior Art)
FIG. 2C shows a side cut away view of a prior art wafer and carrier ring on a polishing pad.
Figure 2D:
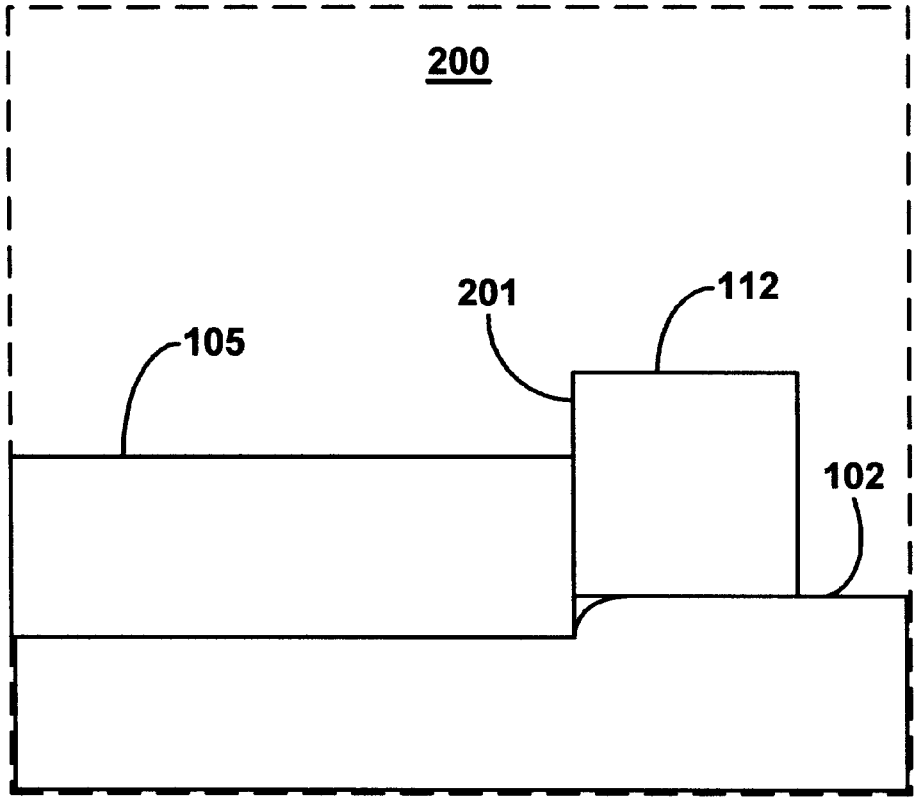
FIG. 2D (Prior Art)
FIG. 2D shows an enlarged portion of the side cut away view of the prior art wafer, carrier ring, and polishing pad of FIG. 2C.
Figure 3A:
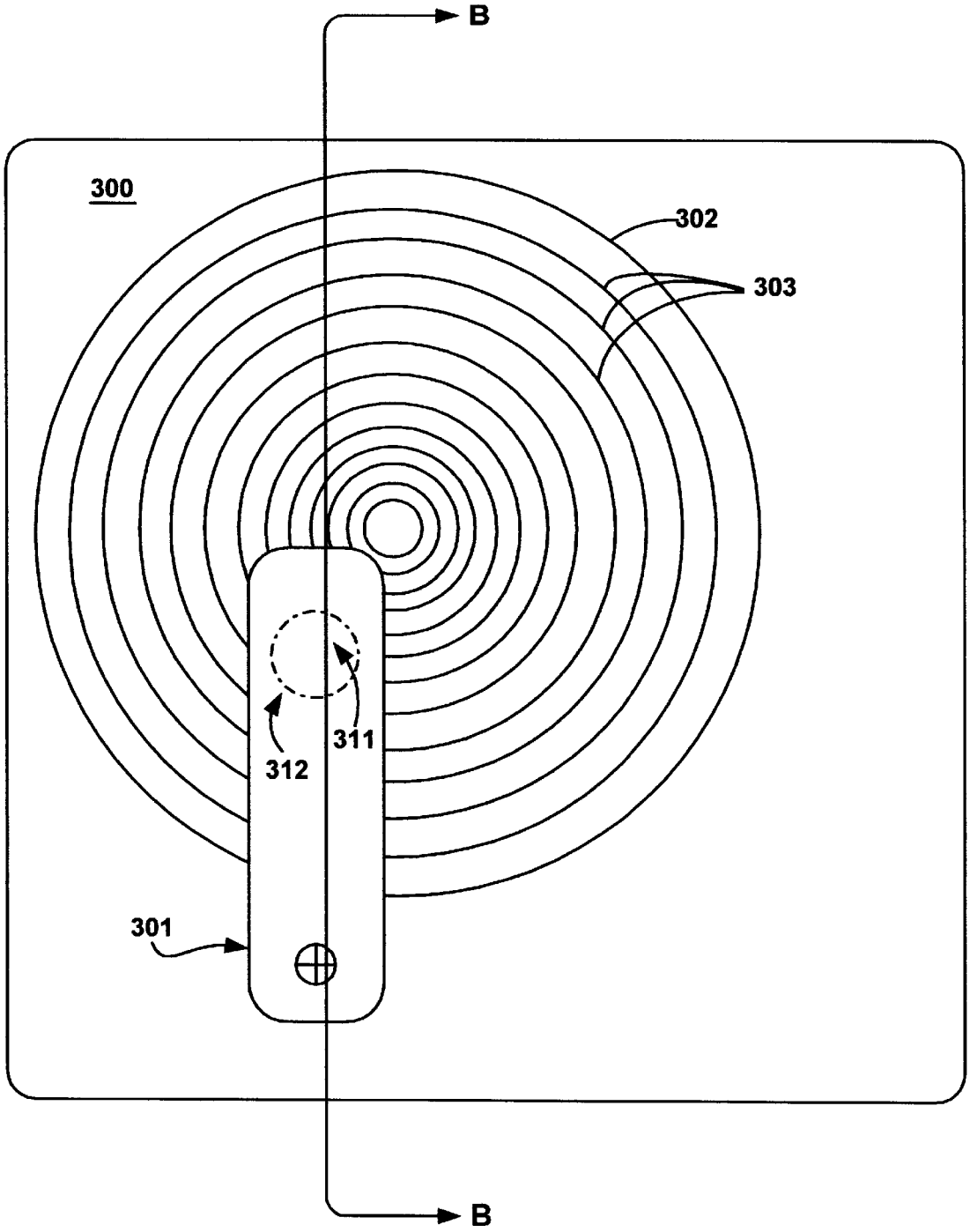
FIG. 3A shows a down view of a CMP machine in accordance with one embodiment of the present invention.
Figure 3B:
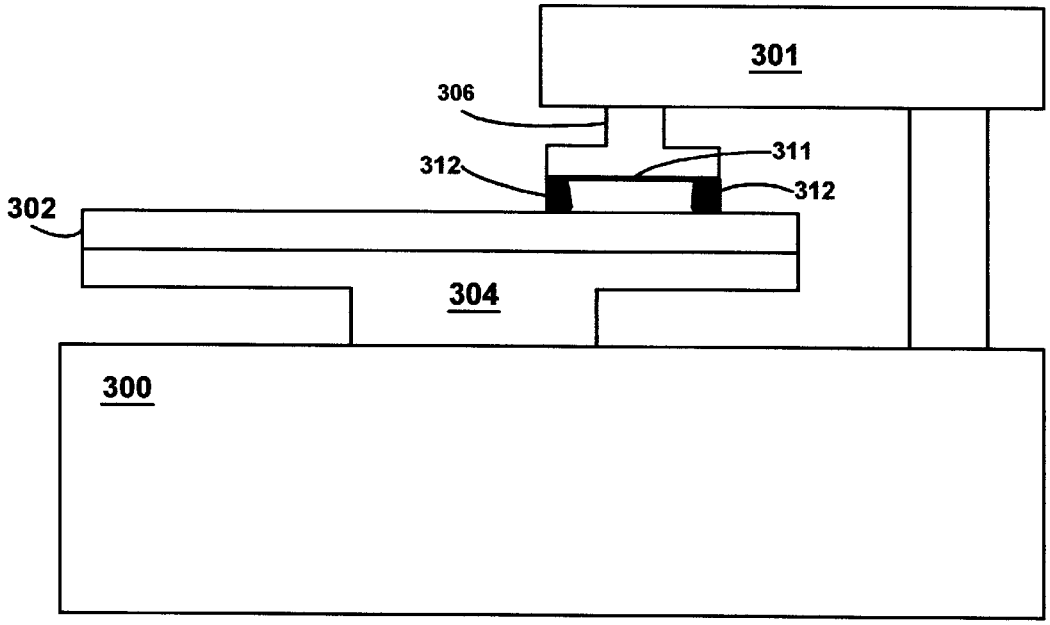
FIG. 3B shows a side cut away view of the CMP machine of FIG. 3A.

Referring now to FIG. 3A and FIG. 3B, a down view of a CMP machine 300 in accordance with the present invention is shown, and a side cut-away view of the CMP machine 300 taken through line B—B is shown. The CMP machine 300 picks up wafers with an arm 301 and places them onto rotating polishing pad 302. The polishing pad 302 is made of a resilient material and is textured with a plurality of groves 303 to aid the polishing process. The polishing pad 302, of CMP machine 300, rotates on a platen 304, or turn table located beneath the polishing pad 302, at a predetermined speed. The arm 301 forces a wafer 311 into the polishing pad 302 with a predetermined amount of down force. The wafer 311 is held in place on the polishing pad 302 and the arm 301 by a slurry dispensing carrier ring 312 and a carrier 306. The lower surface of the wafer 311 rests against the polishing pad 302. The upper surface of the wafer 311 is against the lower surface of the carrier 306 of the arm 301. As the polishing pad 302 rotates, the arm 301 rotates the wafer 311 at a predetermined rate.

In accordance with the present invention, CMP machine 300 utilizes slurry dispensing carrier ring 312 (hereafter dispensing ring 312) for confining wafer 311 to polishing pad 302 as the wafer is polished. During this process, the slurry used by CMP machine 300 is dispensed by dispensing ring 312.

In typical oxide CMP, the slurry is a mixture of de-ionized water and polishing agents designed to aid chemically the smooth and predictable planarization of the upper oxide layer of wafer 311. The rotating actions of both the polishing pad 302 and the wafer 311, in conjunction with the polishing action of the slurry, combine to planarize, or polish, the wafer 311 at some nominal rate. This rate is referred to as the removal rate. A constant and predictable removal rate is important to the uniformity and performance of the wafer fabrication process. The removal rate should be expedient, yet yield precisely planarized wafers, free from surface anomalies. If the removal rate is too slow, the number of planarized wafers produced in a given period of time decreases, hurting wafer through-put of the fabrication process. If the removal rate is too fast, the CMP planarization process will not be uniform across the surface of the wafers, hurting the yield of the fabrication process.

The slurry dispensed by dispensing ring is efficiently utilized due to the fact that it is immediately in contact with wafer 311. As slurry is dispensed, it adheres to the rough texture of the surface of the polishing pad 302 and is transported under the surface of the wafer 311 as both the polishing pad 302 and the wafer 311 rotate. Consumed slurry and polishing by-products, in a similar manner, also adhere to the surface of the polishing pad 302 and are transported away from the surface of the wafer 311. As the polishing process continues, fresh slurry is continually dispensed onto the polishing pad by dispensing ring 312. The polishing process continues until the wafer 311 is sufficiently planarized and removed from the polishing pad 302.

By dispensing slurry directly into contact with wafer 311, dispensing ring 312 reduces the waste of slurry in the CMP process of CMP machine 300. The slurry is "targeted" directly onto wafer 311. In so doing, dispensing ring 312 renders the CMP process more cost effective by using slurry in the most efficient manner. Dispensing ring 312 of the present invention is shown in more detail in FIGS. 4A and 4B below.

Figure 4A:
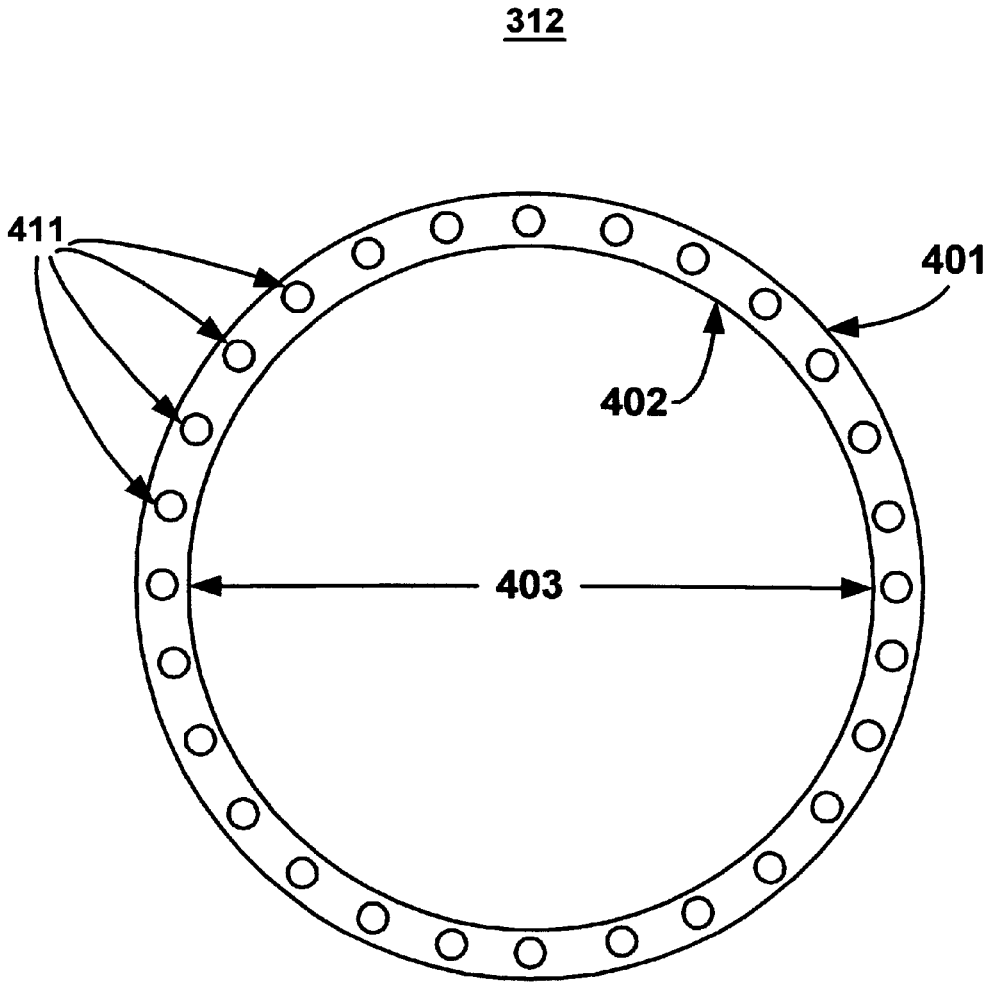
FIG. 4A shows a down view of a dispensing ring in accordance with one embodiment of the present invention.
Figure 4B:
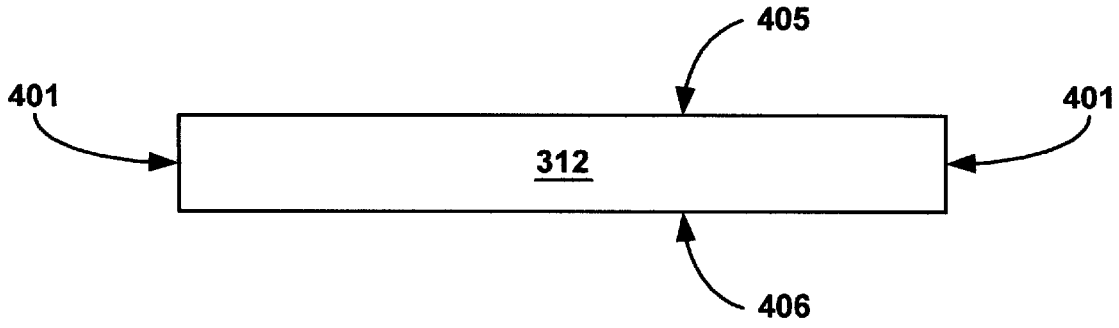
FIG. 4B shows a side view of the dispensing ring of FIG. 4A.

FIG. 4A and FIG. 4B show a down view of dispensing ring 312 and a side view of dispensing ring 312 respectively. As depicted in FIGS. 4A and 4B, dispensing ring 312 of the present embodiment has a diameter 403, a lower surface 406 substantially parallel to the plane defined by the diameter 403, and an inner radius surface 402 substantially orthogonal to the plane defined by the diameter 403. The inner radius surface 402 is adapted to confine the semiconductor wafer (e.g., wafer 311). An outer radius surface 401 is located opposite the inner radius surface 402. An upper surface 405 is located opposite the lower surface 406.

In the present embodiment, a plurality of slurry dispense holes 411 extend through the dispensing ring 312 from the upper surface 405 to the lower surface 406, wherein the slurry dispense holes are adapted to flow slurry from the CMP machine 300 to the lower surface 406 so that the slurry contacts the wafer 311 confined within the inner radius surface 402. As described above, this provides for the more efficient utilization of slurry in the CMP process and minimizes the amount of wasted slurry.

Figure 5:
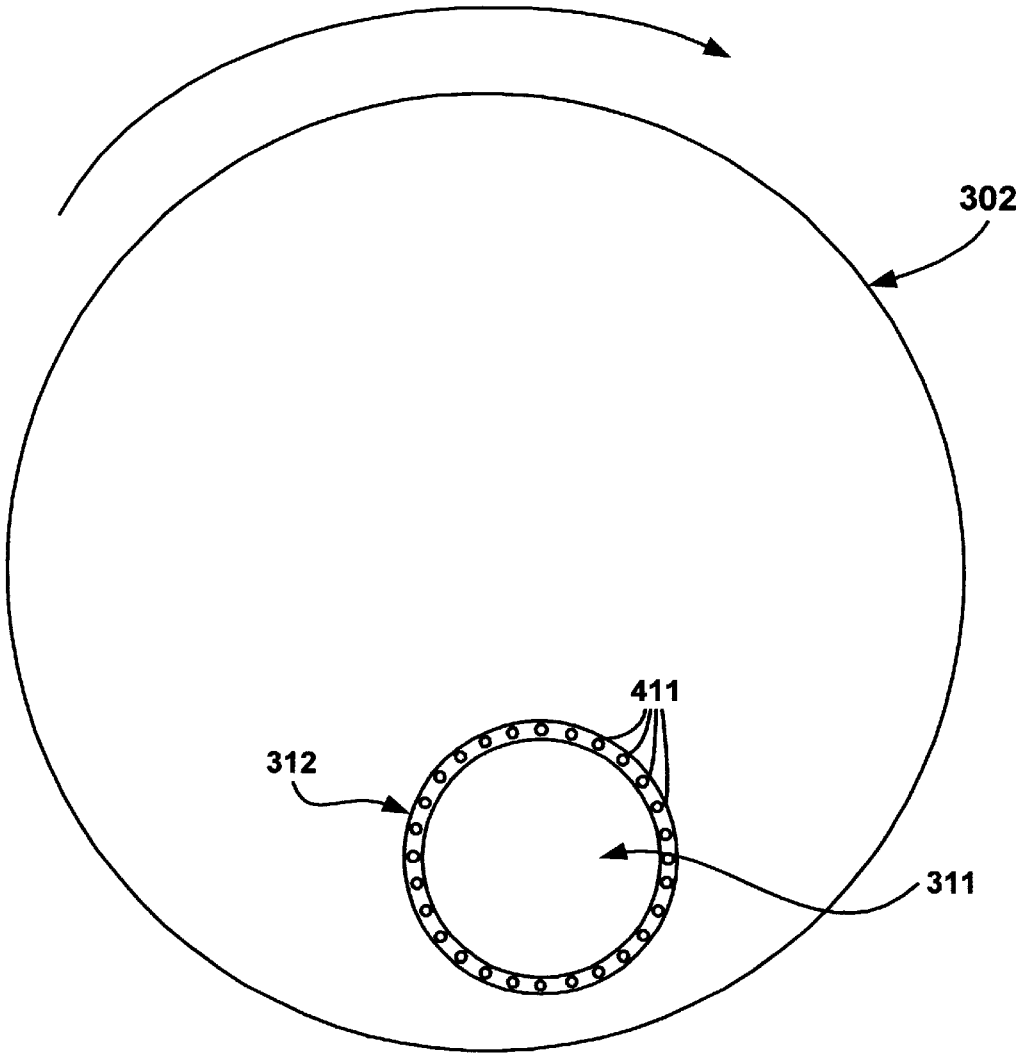
FIG. 5 shows a down view of a dispensing ring and a wafer respect to a polishing pad of a CMP machine in accordance with one embodiment of the present invention

FIG. 5 shows a down view of dispensing ring 312 and wafer 311 on polishing pad 302 as wafer 311 is being polished and dispensing ring 312 is dispensing slurry. As described above, slurry is flowed into contact with wafer 311 via the slurry dispense holes 411. This provides a more targeted delivery of slurry to wafer 311 and eliminates the need for coating the entire surface of pad 302 with slurry.

Figure 6A:
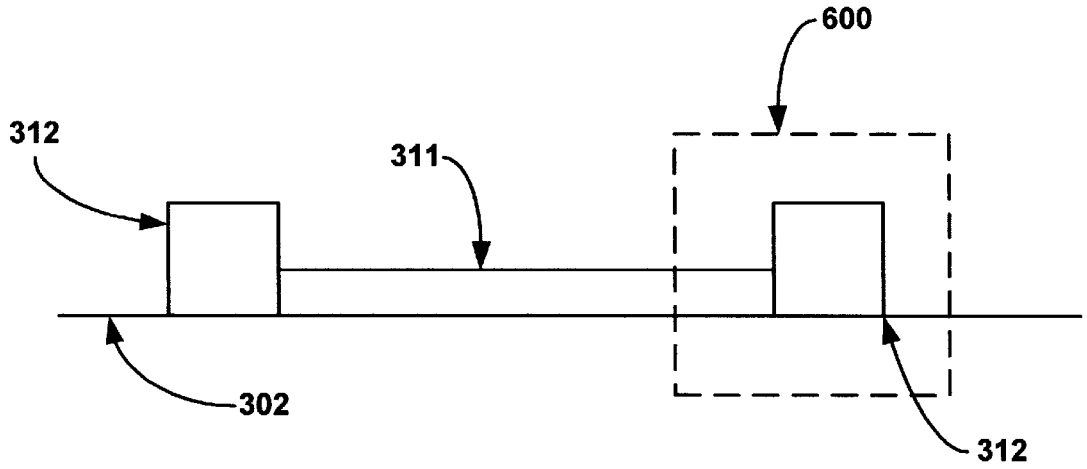
FIG. 6A shows a side cut away view of the dispensing ring, the wafer, and a polishing pad from FIG. 5.
Figure 6B:
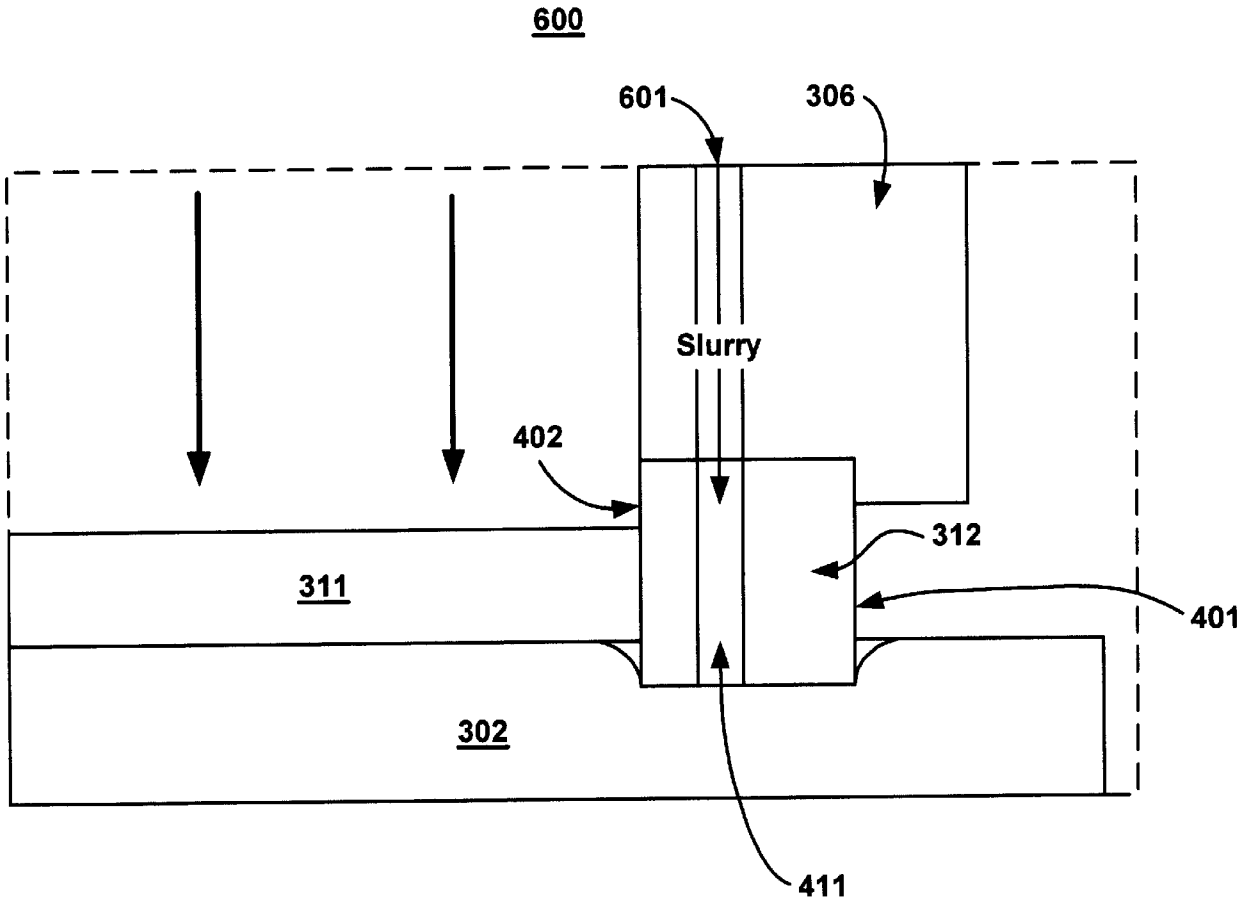
FIG. 6B shows an enlarged portion of the side cut away view of the dispensing ring, the wafer, and polishing pad from FIG. 6A.

With reference now to FIG. 6A and FIG. 6B, FIG. 6A shows a side cut away view of wafer 311 and dispensing ring 312, as wafer 311 and dispensing ring 312 are positioned on top of pad 302. FIG. 6A also shows an area 600, which is shown in greater detail in FIG. 6B. As depicted in FIG. 6B, area 600 shows wafer 311 receiving a downward directed force from the carrier (not shown). Wafer 311 is confined in place on pad 302 by inner radius surface 402. Dispensing ring 312 receives a downward force from arm 306 and is pressed into the resilient surface of pad 302.

In the present embodiment, arm 306 includes a plurality of slurry passages (e.g., passage 601) which align with each of the slurry dispense holes 411. CMP machine 300 pumps slurry though the slurry passages 601, through the slurry dispense holes 411, onto pad 302, and into contact with wafer 311.

FIG. 6B depicts the case where the carrier ring used in a CMP process has a negative amount of protrusion into the surface of polishing pad 302 with respect to the surface of wafer 311. As shown in FIG. 6B, the lower surface of dispensing ring 312 is pressed further into the resilient surface of polishing pad 302 than the lower surface of wafer 311. This negative protrusion amount is used to reduce non-uniformity were the edges of wafer 311 tend to be polished away faster than the center of wafer 311. Many CMP machines used this negative protrusion crucial to decrease the relative force exerted by polishing pad 302 against the edges of wafer 311 in comparison to the force exerted against the center of wafer 311. This counteracts the fact that the edges of wafer 311 have a greater angular velocity (e.g., due to the rotation of wafer 311 by arm 306) on polishing pad 302 than the center of wafer 311. In prior art CMP machines the negative protrusion interfered with the flow of slurry to the surface of wafer 311. In contrast, the dispensing ring 312 of the present invention ensures slurry is delivered uniformly to wafer 311 regardless of any amount of negative protrusion.

It should be noted that slurry can be pumped through dispensing ring 312 in a symmetric or asymmetric manner. In the case where slurry is pumped through dispensing ring 312 in a symmetric manner, each of the slurry dispense holes 411 receives an amount of slurry from a corresponding slurry passage 601 in arm 306. Each of the slurry passages 601 delivers approximately the same amount of slurry to its respective hole of dispense holes 411. In the case where slurry is pumped through dispensing ring 312 in an asymmetric manner, only the slurry dispense holes 411 in a certain region of the dispensing ring 312 receive slurry as the wafer 311 is being polished.

For example, as polishing pad 302 rotates beneath wafer 311, slurry can be pumped to the slurry dispense holes 411 on the "leading-edge" of the dispensing ring 312 with respect to polishing pad 302. This provides the advantage of injecting slurry under the leading-edge of wafer 311 as wafer 311 slides across the surface of polishing pad 302. The slurry subsequently contacts the full surface of wafer 311 with even less waste. This is depicted in FIG. 7 below.

Figure 7:
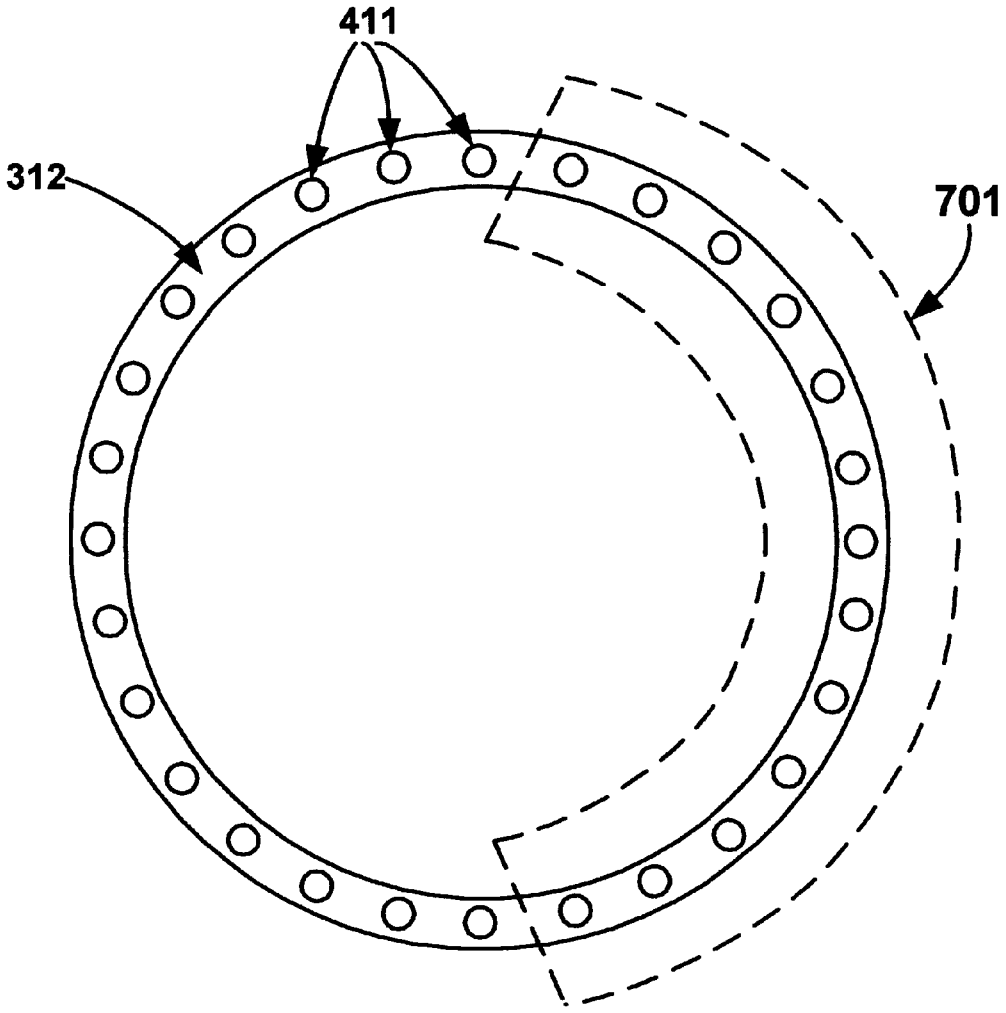
FIG. 7 shows a down view of a dispensing ring and the plurality of included dispensing holes with respect to a dispensing region in accordance with one embodiment of the present invention.

Referring now to FIG. 7, a detail view of dispensing ring 312, slurry dispense holes 411, and a dispensing region 701 is shown. As depicted in FIG. 7, the surface of polishing pad 302 slides underneath dispensing ring 312 from the right side of FIG. 7 to left side of FIG. 7. As described above, in the case of asymmetric slurry injection, slurry is dispensed through the dispense holes of region 701 only. In leading edge asymmetric slurry injection (hereafter referred to simply as leading-edge slurry injection), region 701 covers the leading-edge of dispense ring 312 as dispense ring 312 slides across the surface of polishing pad 302.

It should be noted that dispensing ring 312 rotates as it slides across the surface of polishing pad 302. Accordingly, new slurry dispense holes are constantly being rotated into dispensing region 701 (wherein region 701 remains fixed on the leading-edge of dispensing ring 312) and slurry dispense holes 411 are constantly being rotated out of dispensing region 701. These holes only receive slurry from arm 306 while they are within dispensing region 701. In this manner, fresh slurry is constantly injected underneath the leading-edge of wafer 311 as wafer 311 rotates with respect to polishing pad 302 and as wafer 311 slides across the surface of polishing pad 302.

It should be noted that there are several means of implementing a dispensing region within dispensing ring 312. For example, arm 306 can include a manifold adapted to provide slurry only to those slurry dispense holes 411 which are in the correct region (e.g. within dispensing region 701). This manifold remains fixed even though dispensing ring 312 and wafer 311 are rotated with respect to polishing pad 302. Leading-edge slurry injection is graphically depicted in FIG. 8 below.

Figure 8:
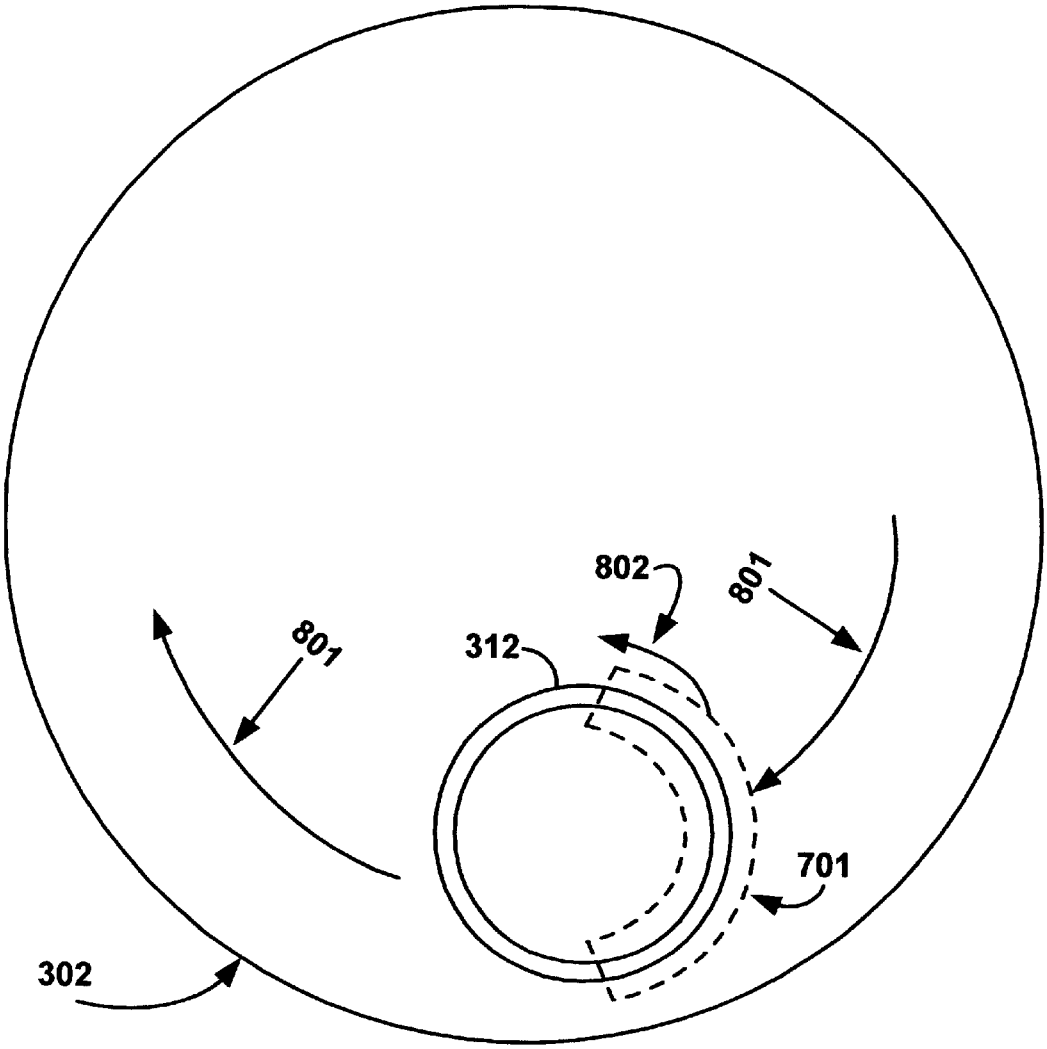
FIG. 8 shows a dispensing ring from FIG. 7 with respect to a polishing pad and its direction of rotation.

With reference now to FIG. 8, leading-edge slurry injection in accordance with one embodiment of present invention is shown. As described above, dispensing region 701 is located on the leading-edge of dispensing ring 312. Arrows 801 show direction of rotation of polishing pad 302 with respect to dispensing ring 312. Arrow 802 shows the direction of rotation of dispensing ring 312 as it is rotated by arm 306 on top of polishing pad 302. Dispensing region 701 is shown by the dotted area. The slurry is injected to the slurry dispense holes 411 within dispensing region 701.

Leading-edge slurry injection provides the advantage of ensuring slurry is not injected underneath the trailing edge of dispensing ring 312 and thus wasted. The slurry injected underneath the trailing edge of dispensing ring 312 rapidly flows away from wafer 311, and is thus not as efficiently utilized as slurry injected underneath the leading-edge dispensing ring 312. Leading-edge slurry injection ensures slurry is rapidly brought into contact with the full surface of the wafer 311 with minimum waste.

In addition to minimizing waste, it should be appreciated that the dispensing ring 312 of the present invention greatly reduces the amount of atmospheric exposure to which the slurry is subjected. Many slurries used in the CMP process tend to react with oxygen in the air. Many slurries also tend to be very sensitive to temperature variations. By precisely targeting the delivery of slurry to the surface of wafer 311, exposure to the atmosphere is limited and the temperature of slurry can be much more tightly controlled. This mitigates the need for exotic gas pressurized (e.g., nitrogen pressurized CMP machine enclosures) CMP machines and the need for expensive temperature regulating equipment. Additionally, modern CMP processes are migrating to the use of higher polishing pad rotation speeds. The increase in polishing pad speeds make the targeted delivery of slurry even more important. For example, in prior art CMP machines, high polishing pad rotation speeds increase the centrifugal force imposed on the slurry, thereby increasing the tendency to "fling" slurry off of the polishing pad before it can be used by wafer 311.

Figure 9:
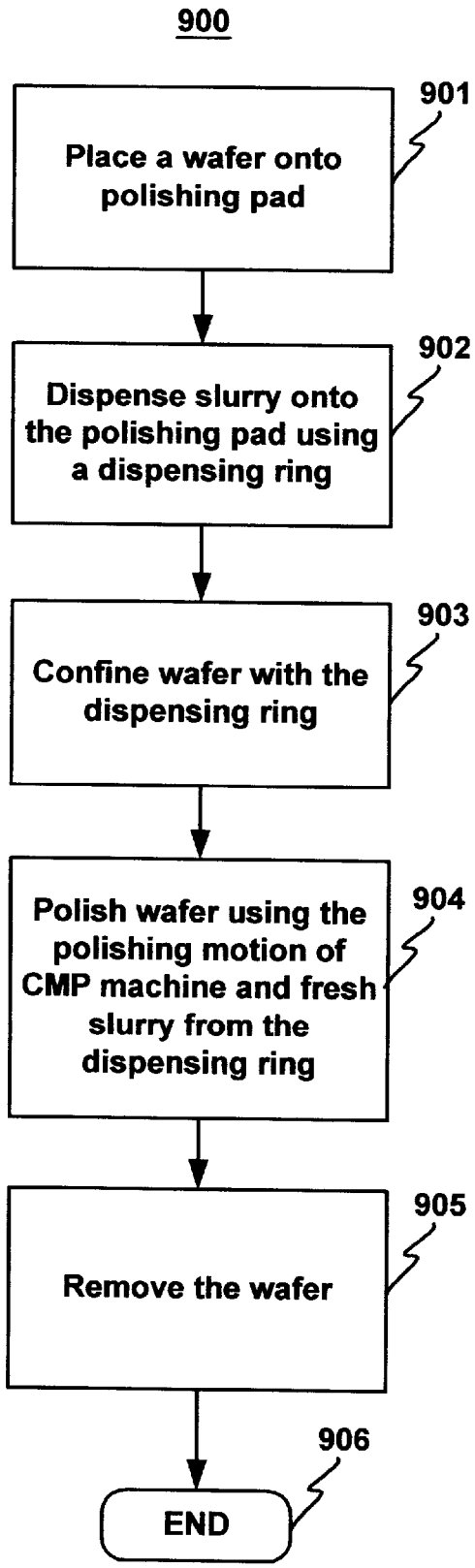
FIG. 9 shows a flow chart of the steps of a dispensing ring process of in accordance with one embodiment of the present invention.

Referring now to FIG. 9, a flow chart of the steps of a polishing process 900 in accordance with one embodiment of the present invention is shown. Process 900 depicts the operating process of a CMP machine (e.g., CMP machine 300) polishing a semiconductor wafer (e.g., wafer 311) using a dispensing ring (e.g., dispensing ring 312) in accordance with one embodiment of the present invention.

Process 900 begins in step 901, where wafer 311 is placed onto the polishing pad 302 of CMP machine 300. As described above, wafer 311 is placed onto polishing pad 302 by arm 306.

In step 902, slurry is dispensed onto polishing pad 302 and into contact with wafer 311. As described above, the slurry is injected via the plurality of slurry dispense holes 411 to the lower surface of dispensing ring 312. The slurry coats the surface of polishing pad 302 within the diameter of dispensing ring 312 and quickly coats the lower surface of wafer 311.

In step 903, wafer 311 is confined in place on polishing pad 302 as the wafer is rotated by arm 306 and as polishing pad 302 rotates on platen 304. The inner radius surface of dispensing ring 312 functions by securely holding wafer 311 in place during the CMP process.

In step 904, the CMP process continues as the wafer is polished using the polishing motion of CMP machine 300 and freshly injected slurry from dispensing ring 312. As CMP continues, dielectric material is continually removed from the surface of wafer 312, thereby achieving the desired planarity.

In step 905, upon the completion of CMP, wafer 311 is removed from polishing pad 302 by arm 306. CMP machine subsequently prepares for a next wafer from a queue and wafer 311 (now in a polished condition) is sent forward in the fabrication line for the next step in processing.

Thus, the slurry dispensing carrier ring of the present invention provides a device that reduces the waste of slurry in the CMP process of a CMP machine. The present invention provides a device that reduces the amount of wasted slurry without the drawbacks of prior art slurry recycling schemes. In addition, the present invention provides a device that renders the CMP process more cost effective by using slurry in the most efficient manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby to enable others skilled in the art best to utilize the invention and various embodiments with various modifications as are suited to the particular use contemplated. It is intended that the scope of the invention be defined by the Claims appended hereto and their equivalents.

What is claimed is:

1. A chemical mechanical polishing machine used for polishing a semiconductor wafer, said chemical mechanical polishing machine comprising:

a polishing pad mounted on the chemical mechanical polishing machine, the polishing pad configured for performing a polishing motion, wherein the chemical mechanical polishing machine implements the polishing motion with respect to the semiconductor wafer;

an arm mounted on the chemical mechanical polishing machine, the arm adapted to place the semiconductor wafer onto the polishing pad and convey a polishing slurry from the chemical mechanical polishing machine to the polishing pad;

a slurry dispensing carrier ring mounted on the arm, the slurry dispensing carrier ring configured to contact and confine the semiconductor wafer on the polishing pad during the polishing motion, the carrier ring having an upper surface including a plurality of slurry dispensing holes for receiving the slurry from the arm and flowing the slurry to a lower surface of the carrier ring and into contact with the polishing pad and the semiconductor wafer during the polishing motion, the upper surface of the slurry dispensing carrier ring adapted to receive a downwardly directed force from the arm; and a slurry manifold included in the arm to convey slurry to the slurry dispensing holes when the slurry dispensing holes are at the leading edge of the semiconductor wafer with respect to the polishing motion and to stop conveying slurry to the slurry dispensing holes when the slurry dispensing holes are at the trailing edge of the semiconductor wafer with respect to the polishing motion.

2. The chemical mechanical polishing machine of claim 1 wherein the slurry dispensing hole of the slurry dispensing carrier ring is further adapted to reduce exposure of the slurry to external air surrounding the chemical mechanical polishing machine.

3. A slurry dispensing carrier ring and manifold apparatus for use in a CMP (chemical mechanical polishing) machine, comprising:

a slurry dispensing carrier ring configured to contact and confine a semiconductor wafer on a polishing pad during a polishing motion, the carrier ring having an upper surface including a plurality of slurry dispensing holes for receiving a slurry from an arm and flowing the slurry to a lower surface of the carrier ring and into contact with the polishing pad and the semiconductor wafer during the polishing motion; and a slurry manifold configured to mount on the arm and to the slurry dispensing carrier ring to convey slurry to the slurry dispensing holes when the slurry dispensing holes are at the leading edge of the semiconductor wafer with respect to the polishing motion and to stop conveying slurry to the slurry dispensing holes when the slurry dispensing holes are at the trailing edge of the semiconductor wafer with respect to the polishing motion.

4. The slurry dispensing carrier ring of claim 3 wherein the upper surface is further adapted to receive a downwardly directed force from the chemical mechanical polishing machine.

5. The chemical mechanical polishing machine of claim 3 wherein the slurry dispensing holes of the slurry dispensing carrier ring are further adapted to reduce exposure of the slurry to external air surrounding the chemical mechanical polishing machine.

6. In a chemical mechanical polishing machine, a method of polishing a semiconductor wafer, said method comprising the steps of:

(a) placing the semiconductor wafer onto a polishing pad of the chemical mechanical polishing machine;

(b) dispensing slurry used for chemical mechanical polishing onto the polishing pad using a slurry dispensing carrier ring having a plurality of slurry dispensing holes;

(c) conveying slurry to the slurry dispensing holes when the slurry dispensing holes are at the leading edge of the semiconductor wafer with respect to the polishing motion and to stop conveying slurry to the slurry dispensing holes when the slurry dispensing holes are at the trailing edge of the semiconductor wafer with respect to the polishing motion using a slurry manifold mounted on the chemical mechanical polishing machine; and (d) polishing the semiconductor wafer through the combined action of flowing the slurry through the slurry dispensing holes of the slurry dispensing carrier ring into contact with the semiconductor wafer and friction of the semiconductor wafer against the polishing pad.

7. The method of claim 6 further including the step of automatically removing the semiconductor wafer from the polishing pad when the semiconductor wafer is sufficiently polished.

8. The method of claim 6 wherein step (d) is comprised of the steps of:

rotating the polishing pad while the semiconductor wafer is in contact with the polishing pad;

rotating the semiconductor wafer and the slurry dispensing carrier ring while the semiconductor wafer is in contact with the polishing pad;

flowing the slurry used for chemical mechanical polishing through the slurry dispensing holes of the slurry dispensing carrier ring into contact with the semiconductor wafer; and polishing the semiconductor wafer through the combined action of friction between the semiconductor wafer and the polishing pad and the slurry used for chemical mechanical polishing between the semiconductor wafer and the polishing pad.

* * * * *